United States Patent [19]

Tibay et al.

[11] 3,951,253

[45] Apr. 20, 1976

[54] TYPEWRITER RIBBON RE-INKER

[76] Inventors: Eulogio C. Tibay; Alfredo C. Tibay, both of 46 Costillo Park Subdivision, Almanza, Las Pinas, Rizal, Philippines

[22] Filed: Sept. 13, 1974

[21] Appl. No.: 505,692

[30] Foreign Application Priority Data

Sept. 17, 1973 Philippines ..... 15027

[52] U.S. Cl. ..... 197/171

[51] Int. Cl.[2] ..... B41J 31/14

[58] Field of Search ..... 197/171, 175; 118/246, 118/260

[56] References Cited

UNITED STATES PATENTS

| | | | |
|---|---|---|---|
| 1,276,263 | 8/1918 | Phelan | 118/246 |
| 1,281,534 | 10/1918 | Donegan | 197/171 |
| 1,414,865 | 5/1922 | Delbare | 197/171 |
| 1,846,498 | 2/1932 | Stephenson | 197/171 |
| 1,953,881 | 4/1934 | Hanable | 197/171 |
| 1,962,309 | 6/1934 | Jewell | 197/171 |
| 2,588,548 | 11/1952 | Markes | 118/260 |
| 2,724,489 | 11/1955 | Fields | 197/171 |
| 3,819,026 | 6/1974 | Ploeger | 197/171 |

*Primary Examiner*—Harland S. Skogquist
*Attorney, Agent, or Firm*—Sughrue, Rothwell, Mion, Zinn and Macpeak

[57] ABSTRACT

A typewriter ribbon re-inker is disclosed which is capable of being readily attachable to a standard typewriter ribbon spool and has the capability of applying different color inks to the ribbon without blurring or intermingling. The sub-base, which is attached to the spool, defines two separate and independent ink vessels in which is placed an ink abosrbing material. The ink absorbing material passes through an extension channel communicating with each ink vessel and contacts a roller to supply ink to the roller. The roller, in turn, contacts the typewriter ribbon to transfer the ink to the ribbon.

4 Claims, 12 Drawing Figures

TYPEWRITER RIBBON RE-INKER

BACKGROUND OF THE INVENTION

This invention relates to a new device that can re-ink used and blurred typewriter ribbons. Almost all typewriter ribbon manufacturers make ribbons on different color basis such as: two-color; red and black; pure black or pure red, wound on the hub of a standard ribbon spool. It is wound on the hub by means of a hook and a reversing eyelet which is placed a few inches away. A few inches near the other end, another eyelet is installed. The ribbon spool has a small hole in the center that passes through the hub.

To install a new ribbon, both spools are removed from the ribbon spool shafts of a typewriter machine. The new ribbon is engaged or hooked in the hub of the empty spool. A few turns of the ribbon is wound on to the empty spool, in the same direction as it comes off the full spool. It should also be noted that the reversing eyelet has been wound up on the empty spool. These two spools are placed on the ribbon spool shafts, so that the ribbon on the right spool comes off the right side and ribbon on the left spool comes off the left side without twisting. The ribbon is then wound around the ribbon rollers through reverse lever slots and finally aligned on the ribbon guide which is in path of the type pallets. The ribbon is wound onto the empty spool by means of the feed ratchet and ribbon detent mechanism in the typewriter. It reverses its movement when the reversing eyelet catches the reversing slots that moves sideways. When this moves, a detent lever is released. The movement of the detent lever releases the feed pawl which engages a tooth of the feed ratchet.

For every character that is pressed manually or electrically, the feed pawl advances a tooth of the feed ratchet. This system of feeding and unwinding the ribbon on the spools is due to the individual operation of the feed pawl. If the feed pawl is engaged with the feed ratchet, then it winds the ribbon and if the feed pawl is out of engagement with the ratchet, the ribbon unwinds. This works automatically feeding the ribbon back and forth until the ribbon becomes blurred. This is the time the device according to the present invention performs its operation.

SUMMARY OF THE INVENTION

The device which has the same circular size as the ribbon spool, is placed on top of one of the ribbon spools attached on the typewriter machine, if the ribbon spools of the machine are lying on top, and sideways, if the ribbon spools are hanging sideways. The device has a sub-base which has a small hole on the center. The thickness of the area surrounding the hole is very thin, so that it can be reamed bigger to suit the size of the ribbon spool shaft and be slipped on the ribbon spool shaft on the height of the shaft extending above the ribbon spool. This can be done simultaneously as the sub-base catch is hooked on the curvature of the ribbon spool attached to the typewriter machine. The device moves freely on top of the ribbon spool and can be moved around on any place to locate the best suitable position. The ribbon is then threaded on as S-path on the exposed faces of the vertical rollers of the device. These two vertical rollers of the device only move or rotate when the ribbon is pulled by the rotation of the ribbon spools caused by the feed ratchet, as friction between the ribbon and the exposed faces of the vertical rollers are always in contact with each other. The felt wick which is also in contact with each of the vertical rollers and lies opposite the exposed faces of the vertical rollers wherein the ribbon is located, applies a uniform and even supply of ink to the vertical rollers. The ink on the vertical rollers, in turn, is transferred to the ribbon. The continuous supply of ink in the felt wick is due to the principle of capillary action. The long felt wick inside a capillary tube housing of the extension arm is continuous to the felt built inside the ink vessel. An air vent bore on top of the ink vessel also greatly helps the operation since air pressure inside the ink vessel pushes out the ink to the vertical rollers of the device. The re-inker may last a month or so, as the ink consumption inside the ink vessel depends on the constant use of the typewriter machine itself.

The main object of this invention is to provide for a longer length of time to use the ribbon, since it could still be re-inked until it is worn-out, torn and then thrown away.

Another object of the invention is to provide a device which will supply more ink on the dry, blurred ribbon.

Still another object of this invention is to help the consumer economize and get their money's worth for the purchase of that particular ribbon.

Another object of this invention is to provide a device that can re-ink ribbons of teletypes; adding machines; accounting machines as well as typewriter machines.

The above and other features of the present invention will be well understood from the following description when read in connection with the accompanying drawings which forms a part hereof and wherein: drafting

DETAILED DESCRIPTION OF THE PREFERRED EMBODIMENT

Figure 1:
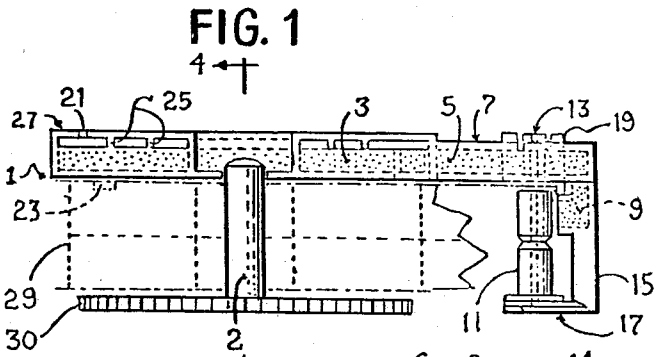
FIG. 1 is a longitudinal sectional view of a first embodiment of the ribbon re-inker device attached to a ribbon spool employing a double ink transfer rollers.
Figure 2:
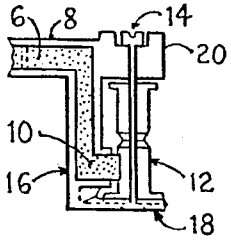
FIG. 2 is a fragmentary portion showing the cutout portion in FIG. 1.

Referring to the drawings in detail, there is shown in FIG. 1 a sub-base 1, having attached thereto sub-base catches 23 and 24. On top of sub-base 1 is an ink vessel 27, with felt pad 3 contained therein. Connected to sub base 1 is an extension arm 7 having wick 5 enclosed therein. The distal end portion of the extension arm 7 is the pin pivot housing 19 having a vertical pin 13 supported by a vertical pin base 17 which holds the vertical roller 11. The end portion of the extension arm 7 holds the felt wick post 15 in-front of said roller such that the felt wick 9 protrudes therefrom and is always in contact with vertical roller 11 in its upper portion. The typewriter ribbon 29 rides on the exposed free arc of the vertical roller 11 which is opposite the felt wick post 15, as the ribbon 29 moves. The movement of the ribbon 29 is due to the feeding of the feed ratchet 30 which is connected to the ribbon spool shaft 2. The device stays on top of the ribbon spool without rotating due to its connection with the ribbon spool shaft 2 and the S-path through which the ribbon 29 traverses in engagement with the rollers 11 and 12. The air vent 21 with its rail support 25 functions by pushing the ink out of the protruding felt wick 9 to the vertical roller 11 as it rotates due to the frictional engagement with the ribbon 29. A second extension arm 8 is also provided, similar in construction to extension arm 7.

The distal end of the extension arm 8 contains the felt wick post 16 constructed at the back of the vertical roller 12 to make the felt wick 10 protrude and always in contact with the vertical roller 12 portion. This vertical roller 12 is at the end of the extension arm 8 fixed to a vertical pin 14 and enclosed inside by pivot pin housing 20 with its corresponding vertical pin base 18.

Figure 3:
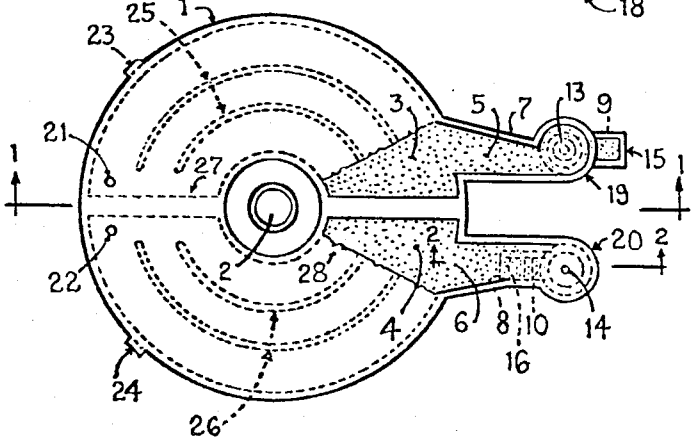
FIG. 3 is a top view of FIG. 1 with partially cut-out portions on the device cover.
Figure 4:
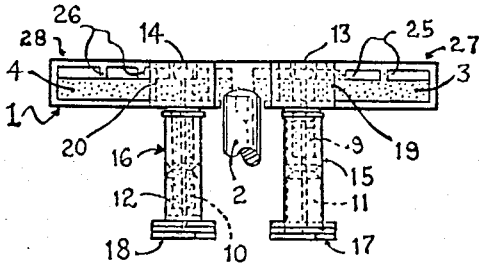
FIG. 4 is a front view of FIG. 3.
Figure 5:
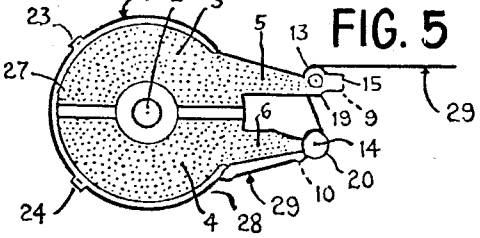
FIG. 5 is a top view of the device with the top cover being removed to expose the inner portion of the ink vessel which contains the felt pads and the felt wick.

As illustrated in FIG. 3, the subbase 1 is provided with a small hole in the center to engage the ribbon spool shaft 2. Two separate ink vessels 27 and 28 are formed which have independent felt pads 3 and 4 enclosed inside. Connected at the end of these ink vessels 27 and 28 are extension arms 7 and 8 having long narrow felt wicks 5 and 6 connected together with the felt pads 3 and 4 inside the ink vessels 27 and 28, respectively. The exposed protruding felt wicks 9 and 10 are always in contact with the vertical rollers 11 and 12. These vertical rollers are always in a straight line held firmly by vertical pins 13 and 14 with a minimum of end play by the pin pivot housings 19 and 20; its corresponding vertical pin bases 17 and 18, and the center bore of the vertical rollers 11 and 12. The drawing shows how the felt wick posts 15 and 16 are constructed as the felt wick post 15 is in-front of rollers 11, 12 while the felt wick post 16 is on the rear side of its corresponding vertical rollers 11 and 12. Therefore, the ribbon 29 is wound around the free exposed arc of the vertical rollers 11 and 12 on an S-pattern as shown in FIG. 5. The device will not rotate when the ribbon moves, as it slides on top of the existing ribbon spool, and cannot be laterally displaced since it engages spool shaft 2 and also the ribbon spool by means of catches 23 and 24.

The ink vessels 27 and 28 are both identical, but are separate and independent of each other and partially divided in the middle by a close partition on both sides. Each of the ink vessels has one small hole which acts as air vents 21 and 22 and with corresponding strengthening rail supports 25 and 26. The felt pads 3 and 4 are continuous and extend into the extension arms 7 and 8. Enclosed inside are the respective felt wicks 5 and 6 which protrude against the vertical rollers 11 and 12. The vertical rollers are held firmly by vertical pins 13 and 14 enclosed by pivot pin housings 19 and 20, and supported by pin bases 17 and 18. End play and slack are reduced to a minimum on vertical rollers 11 and 12 as well as the vertical pins 13 and 14. The felt posts 15 and 16 hold their corresponding felt wicks 9 and 10 in their correct places, felt wick 9 on the upper portion and felt wick 10 on the lower portion of the vertical rollers 11 and 12.

As shown in FIG. 5, the felt pads 3 and 4 as well as the felt wicks 5 and 6 are all laid on top of sub-base 1. The device is held in the center by ribbon spool shaft 2. Both ink vessels 27 and 28 are separately divided in the middle by enclosing both sides permanently. tape Ribbon 29 is wound around the free exposed arc of the vertical rollers 11 and 12 on an S-path.

Figure 6:
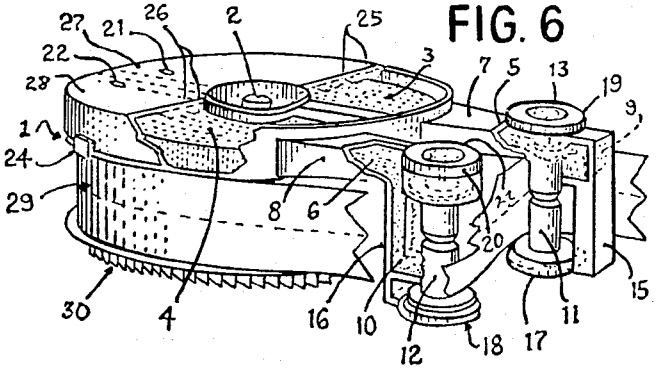
FIG. 6 is a perspective view of the ribbon re-inker device mounted on a ribbon spool and with cut-away portions to show the internal construction.

As shown in FIG. 6, the device is placed on top of the ribbon spool by slipping the center hole over the ribbon spool shaft 2 and at the same time held by catches 23 and 24 on the sides of said ribbon spool. The device can move around and set on the best position but will stay on one place when the operation or movement of the ribbon 29 begins. The vertical rollers 11 and 12 have a wedge-cut in the middle, the main purpose of which is, for a two-color ribbon, to eliminate the tendency of mixing the two-colors on the rollers.

In a second embodiment shown in FIGS. 7–12, inclusive, a single ink transfer roller 35 is used and the protruding channels 7 and 8 are separated only by a strip separator. In the first embodiment, two inking rollers 11 and 12 were employed and the protruding channels 7 and 8 were separated at a distance from each other with separate housings.

Figures 7, 8, 9, 10, 11, 12:
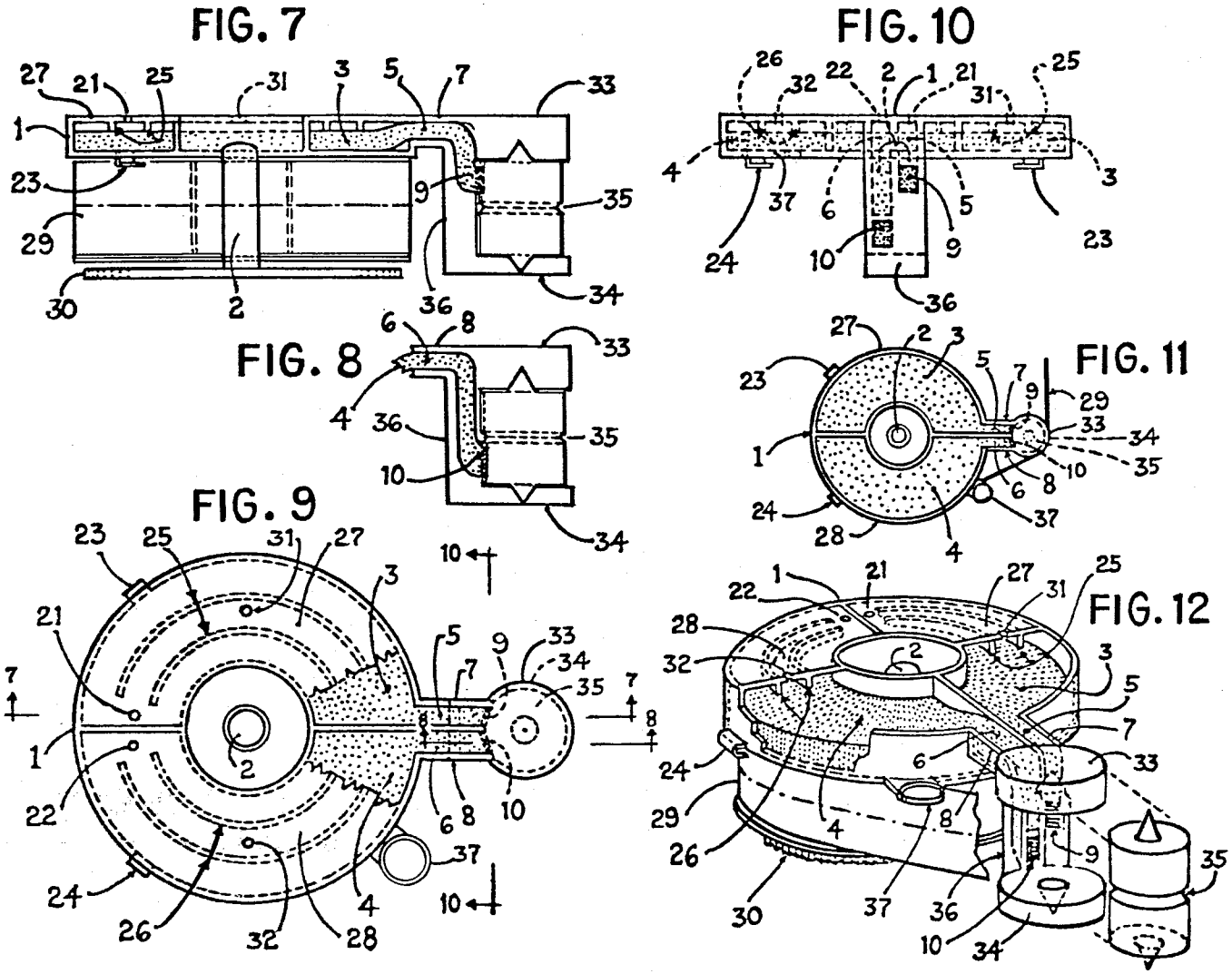
FIG. 7 is a sectional view taken along line 7—7 of FIG. 9 of a second embodiment of a ribbon re-inker device secured to the ribbon spool employing a single ink transfer roller showing one of the color inking felt wicks leading to the first half of the roller.
FIG. 8 is a fragmentary portion showing the color inking felt wick leading to the second half of the transfer rollers.
FIG. 9 is a top view of FIG. 7 with partially cut away portions on the device cover.
FIG. 10 is a sectional view taken along line 10—10 of FIG. 9.
FIG. 11 is a top view of the device with the cover removed to expose the ink vessel.
FIG. 12 is a perspective view of the ribbon re-inker device mounted on a ribbon spool with the top cover being partially cut away to expose the ink vessel and the transfer roller being detached for clarity.

As illustrated in FIG. 7, the upper roller support 33 is attached to an extended portion of the top cover 27 and the lower roller support 34 is the extended portion of channel rail 36, both of which are parallel and in line with the roller 35 to hold it in a vertical position with a minimum end-play. Felt opening 9 is located on the upper portion of single roller 35 and felt opening 10 is located on the lower portion of roller 35 as shown in FIG. 8. Single roller 35 has a wedge-cut in the middle to separate any two different kinds of ink placed on the roller 35 by the protruding felt 5 from felt opening 9 and protruding felt 6 from felt opening 10. Both are slightly touching on the arc faces of roller 35.

FIG. 9 illustrates how extensions 7 and 8 are joined together separating the two by a strip separator and both are in parallel and in line to roller 35. Slip-through circular ring post 37 which is particularly used for teletype printer model 32 or similar models by Teletype Corporation are regarded as optional.

The detailed description of FIGS. 10 – 12, inclusive, needs no further explanation since the reference numerals designating the different parts and their respective functions are the same with those of the first embodiment.

While typical preferred embodiments of the present invention "Typewriter Ribbon Re-Inker," have been disclosed in the foregoing specification and in the accompanying drawings, it will be understood, however, that various modifications within the spirit of this invention may occur to those skilled in the art. Therefore, it is intended that no limitation be defined by the scope of the appended claim in the light of the accompanying drawings.

We claim:

1. A typewriter ribbon re-inker for re-inking a ribbon on a typewriter having at least one ribbon spool wherein said spool has at least one exposed planar surface, said re-inker comprising:

a. a sub-base portion defining two separate and independent ink vessels therein;

b. means defining two extension channels formed with said sub-base portion such that one extension channel communicates with each ink vessel defined by the sub-base;

c. ink absorbing means disposed in each of said ink vessels and said extension channels;

d. at least one roller rotatably attached to a distal end of said extension channel defining means such that it contacts said ink absorbing means and the typewriter ribbon so as to transfer ink from said ink absorbing means to said typewriter ribbon;

e. means to attach said sub-base portion to the exposed planar surface of said typewriter ribbon spool such that said spool may rotate relative to said re-inker; and f. means engaging the typewriter ribbon to prevent rotation of the re-inker as said ribbon spool rotates.

2. A typewriter ribbon re-inker according to claim 1 wherein the means for attaching said sub-base portion to the ribbon spool is in the form of catches formed on said sub-base adapted to freely engage the top circumferential portion of said ribbon spool.

3. A typewriter ribbon re-inker according to claim 1 wherein said extension channels are adjacent each other and separated by a strip separator, the ends of which extension channels terminate in a single ink post having mounted thereon a single ink transfer roller, the respective ends of said channels communicating to an upper and a lower portion of said single roller separated by a wedgecut formation.

4. A typewriter ribbon re-inker according to claim 1 wherein said absorbing means is made of felt material.

* * * * *